US006099658A

United States Patent [19]

Porat

[11] Patent Number: 6,099,658

[45] Date of Patent: Aug. 8, 2000

[54] APPARATUS AND METHOD OF OPERATION FOR HIGH-SPEED SWIMMING POOL CLEANER

[75] Inventor: Joseph Porat, North Caldwell, N.J.

[73] Assignee: Aqua Products Inc., Cedar Grove, N.J.

[21] Appl. No.: 09/162,953

[22] Filed: Sep. 29, 1998

[51] Int. Cl.[7] ..... B08B 7/04

[52] U.S. Cl. ..... 134/18; 134/22.1; 134/58 R; 134/167 R; 15/1.7; 210/143; 210/169

[58] Field of Search ..... 134/18, 22.1, 22.18, 134/57 R, 58 R, 167 R; 15/1.7; 210/143, 169

[56] References Cited

U.S. PATENT DOCUMENTS

| | | | |
|---|---|---|---|
| 4,786,334 | 11/1988 | Nystrom | 134/18 |
| 5,001,800 | 3/1991 | Parenti et al. | 15/1.7 |
| 5,507,058 | 4/1996 | Minami et al. | 15/1.7 |
| 5,569,371 | 10/1996 | Perling | 210/169 |
| 5,985,156 | 11/1999 | Henkin et al. | 134/167 R |

*Primary Examiner*—Randy Gulakowski
*Assistant Examiner*—Saeed Chaudhry
*Attorney, Agent, or Firm*—Abelman, Frayne & Schwab

[57] ABSTRACT

An apparatus and method for cleaning the bottom and vertical side walls of a swimming pool, pond or tank employs a robotic, self-propelled cleaner having a protective housing of conventional design, the cleaner being operated at a primary cleaning speed as it traverses the surfaces to be cleaned and until the cleaner housing emerges from the water along a sidewall of the pool; thereafter the cleaner operates at a secondary drive speed that is relatively slower than the primary speed and the cleaner thereafter reverses direction and descends for a pre-determined period of time at the slower secondary speed in order to permit the air entrained under the housing to escape without destabilizing the cleaner during descent. After the predetermined period of time, the cleaner resumes operation at the more rapid primary speed until the cleaner housing once again emerges from the water's surface, after which the cycle is repeated.

24 Claims, No Drawings

APPARATUS AND METHOD OF OPERATION FOR HIGH-SPEED SWIMMING POOL CLEANER

FIELD OF THE INVENTION

The invention relates to automated, power-driven pool cleaners employed in the unattended cleaning of the bottom and side walls of swimming pools and tanks.

BACKGROUND OF THE INVENTION

Automated swimming pool cleaners have been developed for the cleaning of the bottom and side walls of pools by programming the electrically-powered cleaner to traverse the bottom of the pool in one direction, and climb the side wall of the pool that it encounters until the leading end of the cleaner emerges at the waterline of the pool. Thereafter, the drive mechanism is reversed which causes the pool cleaner to reverse direction and to descend the vertical side wall until it encounters the bottom of the pool, at which point it undergoes a transition to return to a generally horizontal position to again begin its traverse of the bottom of the pool. By means of various structural and/or electro-mechanical devices operated in response to a preprogrammed microprocessor controller, the pool cleaner can be made to traverse an ever-changing, but generally predictable pattern across the bottom and up and down the side walls of the pool in order to clean the entire bottom surface. The pool cleaner also traverses horizontally along the side wall of the pool to clean the so-called scum line that often forms at the waterline.

Pool cleaners of the prior art are designed to operate at a substantially continuous speed, whether they be driven by electric motors or water turbines. Minor variations in speed may occur at the transition zone where the pool cleaner moves from a generally horizontal position at the bottom of the pool to assume a vertical position on the side wall, and vice-versa. Other minor variations may be observed when the direction of travel of the pool cleaner is reversed, for example, when the pool cleaner begins its descent from the waterline along the side wall of the pool. Further minor variations between the speed at which the cleaner traverses the bottom of the pool and that at which it ascends and/or descends along the side wall due to gravitational effects which act upon the cleaner despite its neutrally buoyant design. However, these variations in speed are relatively minor and do not occur as a result of the preprogrammed operation of the cleaner and do not improve the functioning of the cleaner.

Swimming pool cleaners of the prior art operate at speeds in the range from about five feet per minute to ten feet per minute. Depending upon the size of the pool to be cleaned, the unit may have to be placed in operation for as long as six to eight hours to clean a large municipal or commercial swimming pool. The cleaning of larger pools must be done when the pool is not in use, generally overnight, over a weekend, or at other times when it is not convenient or economical to have maintenance personnel on duty to attend the cleaning of the pool. Although the power supply to the pool cleaner can be put on a timer, various circumstances can arise that will interfere with, or entirely interrupt the operation of the cleaner so that only a portion of the pool has been cleaned during the allocated cycle. For example, the floating power cord can become entangled, thereby disrupting the programmed cleaning pattern; the cleaner can become trapped in a corner, or against a ladder or other obstruction at the side of the pool.

In order to permit the pool cleaner to traverse the bottom of the pool and to ascend and descend the side walls of the pool during its cleaning operations, the pool cleaner is of substantially neutral bouyancy with respect to the water in the pool. Thus, variations in water density between fresh water and salt water pools must also be taken into account in the construction of pool cleaners for these different environments. For example, additional weights can be attached to the cover and/or base plate of a pool cleaner that is neutrally buoyant with respect to fresh water in order to adapt it for use in a salt water pool. As will be understood by one familiar with the art, when the pool cleaner ascends to the waterline to clean the wall surface at the scum line, a portion of the pool cleaner projects above the surface of the pool. Air enters the space between the cover and the base plate, and when the pool cleaner begins its descent along the wall, the air must be displaced by the water in order to maintain the designed neutral buoyancy of the cleaner. It has also been observed that when the pool cleaner is initially placed in the pool, the owner or maintenance personnel typically lowers the unit in a vertical position on the side wall and activates the power supply.

It has been found that when pool cleaners of the prior art are operated at higher speeds, the rapid descent from the waterline results in air becoming entrained in the space between the cover and base plate causing the cleaner to float away from its operating position and vertical alignment on the wall. If the air is not displaced, the cleaner will float at the surface of the pool; if the air is eventually displaced and the cleaner sinks to the bottom of the pool it can remain in an inoperable position with respect to the bottom of the pool, or if it does land upright on the bottom surface, its programmed pattern of operation will have been disrupted and areas of the pool will be left uncleaned.

It is therefore an object of the present invention to provide an apparatus and a method for increasing the speed at which the pool is cleaned, thereby reducing the overall operating time of the pool cleaner.

It is another object of the invention to provide a pool cleaner that operates at a speed that is significantly greater than that of commercially available pool cleaners of the prior art.

It is yet another object of the invention to provide a power-driven automated pool cleaner that will rapidly traverse the bottom and ascend the side walls of a pool and that will descend from the waterline while maintaining continuous operative cleaning contact with the side wall of the pool.

It is also an object of the invention to provide an apparatus and method for rapidly cleaning the side walls of pools a the scum line.

It is another important object of the invention to provide a pool cleaning apparatus that operates at speeds significantly greater than those of the prior art while maintaining its neutral buoyancy at all stages of its cleaning operations.

SUMMARY OF THE INVENTION

The above objects, as well as further advantages, are attained by providing an improved automated power driven pool cleaning apparatus for cleaning the bottom and sidewalls of a pool comprising:

(a) drive means for moving the cleaner in forward and reverse directions; and (b) control means associated with the drive means for operating the cleaner at a primary drive speed and at a secondary drive speed that is relatively slower than the primary drive speed when the cleaner begins to descend from the waterline at the side wall of the pool, where the drive means operates at the secondary speed for a predetermined operational period of time that is relatively short as compared to the time of operation at the primary speed.

In the practice of one preferred embodiment of the invention, a pool cleaner having a cover and drive means for moving the cleaner in forward and reverse directions is provided with control means and with signal generating means which cooperate to cause the drive means to operate at a slower speed when the cleaner descends from the waterline at the side wall of the pool, thereby allowing any air entrained under the corer -o be displaced by water as the cleaner descends in operational cleaning contact with the wall of the pool.

In a first preferred embodiment, the pool cleaner is provided with a preprogrammed microprocessor controller that causes the cleaner to operate upon activation at a relatively slower secondary drive speed for an initial predetermined period of time. The initial predetermined time is sufficient to permit the cleaner to release entrapped air when the unit is placed on the side wall at start-up. Thereafter, the controller causes the speed to increase to the more rapid primary drive speed. After the cleaner has traversed the bottom and ascended a side wall, it is again slowed to descend the side wall at the secondary drive speed.

The change in speed to a significantly slower speed for descending from the waterline can be in response to a signal generated upon the occurrence of a prior event. One such prior event can be the transition of the pool cleaner from a generally horizontal position on the bottom of the pool to a generally vertical position as it climbs the side wall of the pool. A signal can be generated by a switch that is activated in response to the change of orientation, for example, a mercury switch or a pendulum switch. Alternatively, a signal can be generated when the leading edge of the pool cleaner emerges from the surface of the water above the waterline, e.g., by the movement of a float switch.

The control signal is transmitted to a timer which in turn transmits a signal to the microprocessor that controls the speed and direction of the drive means. In a preferred embodiment, the pool cleaner moves horizontally along the side wall at the waterline in order to remove any scum and dirt that has accumulated there. The cleaner can traverse horizontally at the more rapid primary drive speed, or at the much slower secondary drive speed. However, at the preprogrammed time for descent from the waterline, the cleaner descends at the secondary drive speed or slower descending drive speed. It will be understood that the relatively slower secondary drive speed is determined empirically, or otherwise, to insure that any air entrained by operation of the cleaner at the waterline can be readily displaced as the cleaner descends along the wall to maintain substantially neutral buoyancy and operational cleaning contact by the cleaner on the wall.

In an especially preferred embodiment, the microprocessor controller is programmed to cause the drive means to operate at the slower secondary speed when the cleaner is initially activated. This is an important feature, since the person transferring the cleaner from its transporting cart at the edge of the pool is likely to grasp the cleaner by its handle and lower it into the pool in contact with the side wall. If the power switch is activated while the cleaner is at the surface of the pool, it will descend at the slower secondary speed which permits the entrained air to escape from under the housing or cover.

In this embodiment, the microprocessor controller is programmed to cause the drive means to operate at the secondary speed for a predetermined start-up period of time before operating at the faster primary drive speed. The predetermined start-up time period can be longer than, or about the same as the predetermined operational period of time. Depending upon the size and structural configuration of the cleaner housing, these time periods can be from about five seconds to about fifteen seconds.

In order to simplify the design and construction of the pool cleaner and the programming of the microprocessor controller in accordance with the objectives of the invention, the cleaner is adapted to operate at the slower secondary drive speed for a predetermined operational period of time that is sufficient to insure that any entrained air will be purged from the interior of the cover. This predetermined period of time can range from about 5 to about 15 seconds, and as explained above, is determined based upon the design and operation of the specific pool cleaner, including features such as the configuration of the cover, the position of the intake ports in the base plate, and the like.

In order to achieve the goal of more rapidly completing the cleaning of the pool, the time of operation at the more rapid primary drive speed should be maximized and the time of operation at the slower secondary drive speed or descending drive speed should be kept to a minimum. However, in order to provide a universally acceptable commercial machine, the predetermined operational period of time for operation at the secondary or descending drive speed must take into account varying dimensional features found in a range of pool designs. In any event, operation at the descending secondary drive speed can result in enhanced cleaning performance of the contacted surfaces.

A further advantage of operating the pool cleaner at the more rapid primary drive speed at the waterline is to enhance the ability of the pool cleaner to turn the corner of the pool, i.e., to move from one wall surface to an intersecting wall surface at the corner of the pool. This enhanced cornering ability results from the greater momentum and traction achieved at the faster primary drive speed.

DESCRIPTION OF PREFERRED EMBODIMENTS

A pool cleaner having drive means comprised of a DC electric motor attached through pulleys and drive belts to a pair of transverse cleaning brushes is provided with a preprogrammed microprocessor controller that is adapted to move the pool cleaner on the bottom of the pool at a primary drive speed of about 30 ft. per minute. A mercury switch is affixed beneath the cover of the cleaner and electrically connected to a timer associated with the microprocessor. In a preferred embodiment, the timer is integrated into the microprocessor controller. When the pool cleaner is placed in an operational position on the bottom of the pool, the mercury switch is in an open position. When the pool cleaner is in an operational or vertical position on the side wall of the pool, the mercury switch moves with respect to the cover and transmits a signal that is received by the timer.

The cleaner continues to ascend the side wall and upon reaching the waterline begins to move horizontally along the side wall to scrub the scum line. In the preferred embodiment, the timer operates for a random period of time which can be for about 10 to about 30 seconds before stopping and reversing the drive means to cause the cleaner to descent the sidewall at the slower secondary drive speed. As the cleaner starts its descent, air from under the cover is displaced by water and the cleaner maintains operational contact with the side wall.

The cleaner completes its descent from the sidewall and begins to traverse the bottom of the pool at the secondary drive speed After the preprogrammed period of light seconds, the timer transmits a signal to the microprocessor controller which cause the DC motors to increase to the primary drive speed to about 30 feet/second which is about twice the secondary speed. The pool cleaner rapidly traverses the long dimension of the pool bottom, ascends the wall to the waterline, move horizontally along the waterline for a randomly determined time of about seven seconds, after which the DC motors ar stopped and reversed to cause the drive means to move the cleaner down the side wall at the secondary drive speed of about twelve to fourteen feet/second, and thereafter to assume a different course in traversing the bottom of the pool.

I claim:

1. A method of operating a power-driven pool cleaner to clean the bottom and side walls of a pool or tank, the method comprising the steps of (a) providing a pool cleaner having a cover, drive means for moving the cleaner in forward and reverse directions and a timer;

(b) activating the pool cleaner while the cleaner is in operating position in the pool;

(c) causing the pool cleaner to traverse the bottom of the pool in a forward direction at a primary drive speed until the cleaner encounters a side wall of the pool;

(d) causing the pool cleaner to ascend the side wall of the pool to the waterline of the pool;

(e) generating a control signal when the cleaner is in a vertical orientation on the side wall of the pool;

(f) activating the timer in response to the control signal;

(g) changing the drive speed of the pool cleaner to a secondary drive speed that is relatively slower than the primary drive speed while the cleaner is at the waterline of the pool;

(h) operating the cleaner for a predetermined operational period of time at the secondary drive speed;

(i) causing the cleaner to descend the side wall of the pool at the secondary speed, whereby any air entrained under the cover is displaced as the cleaner descends in contact with the side wall; and (j) changing the drive speed of the pool cleaner after the predetermined operational period of time to the primary drive speed.

2. The method of claim 1 comprising the further steps of:

(k) causing the pool cleaner to traverse the bottom of the pool and ascend a side wall of the pool at the primary drive speed;

(l) changing the speed of the pool cleaner to the secondary drive speed while the cleaner is at the waterline and operating the cleaner for the predetermined operational period of time at the secondary drive speed;

(m) causing the cleaner to descend the side wall at the secondary drive speed;

(n) changing the drive speed of the pool cleaner after the predetermined period of time to the primary drive speed; and (o) repeating steps (c) through (n).

3. The method of claim 1 comprising the further steps of:

upon activation of the pool cleaner, operating the pool cleaner drive means at the secondary drive speed for a predetermined start-up period of time; and at the end of the predetermined start-up period of time operating the drive means at the primary drive speed.

4. The method of claim 1 where the predetermined start-up and operational periods of time are sufficient to permit the cleaner to descend from the waterline of the pool to the bottom of the pool.

5. The method of claim 1 where the predetermined start-up and operational periods of time are substantially the same.

6. The method of claim 1 where the first and second predetermined periods of time are each from about 5 to about 15 seconds.

7. The method of claim 4 where the pool cleaner operates at the primary speed to advance along the side wall of the pool at the waterline.

8. The method of claim 4 where the pool cleaner operates at the secondary drive speed after the cleaner reaches the waterline of the pool.

9. The method of claim 1 where the direction and speed of the drive means are varied by a preprogrammed microprocessor.

10. The method of claim 8 where the microprocessor includes the timer.

11. The method of claim 1 where the control signal is generated by a control signal switch.

12. The method of claim 11 where the control signal switch moves with respect to the cleaner housing.

13. The method of claim 12 where the control signal switch is a mercury switch.

14. The method of claim 1 where the primary drive speed from about three to about five times faster than the secondary drive speed.

15. The method of claim 1 where the primary drive speed is from about twenty-four feet per minute to about thirty-six feet per minute.

16. The method of claim 1 where the secondary drive speed is predetermined to permit air entrained under the cover to be displaced while the cleaner maintains contact with the side wall of the pool being cleaned.

17. An improved method for cleaning the bottom and side walls of a swimming pool or tank using a power-driven pool cleaner, the method comprising:

(a) placing the pool cleaner in a horizontal operative position on the bottom of the pool;

(b) causing the pool cleaner to traverse the bottom of the pool at a primary speed in the range from about twenty-four to about thirty-six feet per minute;

(c) causing the pool cleaner to move horizontally along the waterline of the pool or tank;

(d) causing the cleaner to descend from the waterline of the pool at a secondary speed that is less than the primary speed, the rate of descent at the secondary speed being sufficient to permit displacement of any entrained air in the pool while maintaining the pool cleaner in cleaning contact with the side wall of the pool.

18. The method of claim 17 where the secondary speed is in the range of from about four to about fifteen feet per minute.

19. The method of claim 17 where the pool cleaner is operated at the secondary speed for a predetermined operational period of time.

20. The method of claim 19 where the predetermined operational period of time is from about 5 to about 10 seconds.

21. The method of claim 17 where the commencement of the operation of the cleaner at the secondary speed is in response to a change in the orientation of the cleaner from a generally horizontal to a generally vertical position.

22. The method of claim 17 where the commencement of the operation of the cleaner at the secondary speed is in response to a control signal generated when a portion of the cleaner emerges from the water at the waterline of the pool.

23. The method of claim 21 where the pool cleaner commences operation at the secondary speed after a predetermined delay period of time following the change in orientation from a generally horizontal to vertical position.

24. The method of claim 19 which further comprises operating the pool cleaner at the primary speed after the predetermined operational period of time.

* * * * *